US010527390B1

(12) United States Patent
Carter

(10) Patent No.: US 10,527,390 B1
(45) Date of Patent: Jan. 7, 2020

(54) SYSTEM AND METHOD OF MARKSMANSHIP TRAINING UTILIZING AN OPTICAL SYSTEM

(71) Applicant: George Carter, Dallas, TX (US)

(72) Inventor: George Carter, Dallas, TX (US)

( * ) Notice: Subject to any disclaimer, the term of this patent is extended or adjusted under 35 U.S.C. 154(b) by 0 days.

(21) Appl. No.: 16/243,316

(22) Filed: Jan. 9, 2019

Related U.S. Application Data

(63) Continuation-in-part of application No. 15/361,287, filed on Nov. 25, 2016, now Pat. No. 9,782,667, which is a continuation-in-part of application No. 14/498,112, filed on Sep. 26, 2014, now Pat. No. 9,504,907, which is a continuation-in-part of application No. 14/168,951, filed on Jan. 30, 2014, now Pat. No. 8,888,491, which is a continuation-in-part of application No. 13/611,214, filed on Sep. 12, 2012, now Pat. No. 8,678,824, which is a continuation-in-part of application No. 12/608,820, filed on Oct. 29, 2009, now Pat. No. 8,459,997, application No. 16/243,316, which is a continuation-in-part of application No. 15/698,615, filed on Sep. 7, 2017, now Pat. No. 10,213,679.

(60) Provisional application No. 61/156,154, filed on Feb. 27, 2009.

(51) Int. Cl.
*F41G 3/26* (2006.01)

(52) U.S. Cl.
CPC ..... *F41G 3/2605* (2013.01)

(58) Field of Classification Search
CPC ..... F41G 3/26; F41G 3/2605; F41G 3/2611; F41G 3/2615; F41G 3/2616; F41G 3/2627; F41G 3/2644; F41G 3/2655; F41A 33/00; F41A 33/02; F41A 33/04; F41A 33/06; A63F 9/0921
See application file for complete search history.

(56) References Cited

U.S. PATENT DOCUMENTS

| | | | |
|---|---|---|---|
| 5,215,462 | A | 6/1993 | Lewis et al. |
| 6,569,011 | B1 | 5/2003 | Lynch et al. |
| 6,813,593 | B1 | 11/2004 | Berger |
| 6,899,539 | B1 | 5/2005 | Stallman et al. |
| 7,329,127 | B2 | 2/2008 | Kendir et al. |
| 8,794,967 | B2 | 8/2014 | Sargent |
| 2005/0181745 | A1 | 8/2005 | Wood et al. |
| 2007/0190494 | A1 | 8/2007 | Rosenberg |
| 2007/0190495 | A1 | 8/2007 | Kendir et al. |
| 2007/0243504 | A1 | 10/2007 | Bjorkman et al. |

(Continued)

*Primary Examiner* — Timothy A Musselman
(74) *Attorney, Agent, or Firm* — Michael Diaz

(57) ABSTRACT

A shooting simulation system and method. The system includes a plurality of firearms. Each firearm is associated with a separate soldier having a man-worn computer, a location device for determining a location of the soldier, an optical system for capturing an image where the captured image provides information on a trajectory of a virtual bullet fired from a shooting firearm, and an orientation device for obtaining the orientation of the firearm when shooting the firearm. The optical system is aligned with a sight of the shooting firearm and captures the image when shooting the firearm. The system also includes a shooter/target location resolution module for identifying a valid target and a target image recognition module for determining an impact location where a virtual bullet from the shooting firearm would impact within the captured image and determining if an identified target from the captured image is a hit or a miss.

20 Claims, 5 Drawing Sheets

(56) References Cited

U.S. PATENT DOCUMENTS

| | | | |
|---|---|---|---|
| 2009/0305197 | A1 | 12/2009 | Lim et al. |
| 2015/0057057 | A1 | 2/2015 | Fischer |

SYSTEM AND METHOD OF MARKSMANSHIP TRAINING UTILIZING AN OPTICAL SYSTEM

RELATED APPLICATIONS

This application is a continuation in part of co-pending Ser. No. 15/698,615 entitled "Shooting Simulation System And Method Using An Optical Recognition System filed Sep. 7, 2017 under the name of George Carter which is a continuation-in-part application of U.S. Pat. No. 9,782,667 entitled "System and Method of Assigning a Target Profile for a Simulation Shooting System" filed Nov. 25, 2016 under the name of George Carter which is a continuation in part of U.S. Pat. No. 9,504,907 entitled "Simulated Shooting System and Method" filed Sep. 26, 2014 under the name of George Carter which is a continuation-in-part of U.S. Pat. No. 8,888,491 entitled "An Optical Recognition System and Method For Simulated Shooting" filed on Jan. 30, 2014 under the name of George Carter which is a continuation-in-part application of U.S. Pat. No. 8,678,824 entitled "Shooting Simulation System and Method Using an Optical Recognition System" filed on Sep. 12, 2012 under the name of George Carter which is a continuation-in-part application of U.S. Pat. No. 8,459,997 entitled "Shooting Simulation System and Method" filed on Oct. 29, 2009 under the name of George Carter which claims the benefit of U.S. Provisional Patent Application Ser. No. 61/156,154 filed Feb. 27, 2009 by George Carter, all of which is hereby incorporated by reference.

BACKGROUND OF THE INVENTION

Field of the Invention

This invention relates to simulation shooting systems and methods. Specifically, and not by way of limitation, the present invention relates to a system and method providing marksmanship training utilizing an optical system.

Description of the Related Art

Realistic training of personnel is a necessary component to create and maintain an effective fighting unit or law enforcement team. For the military, realistic training provides experience for soldiers prior to encountering actual real-world combat. Training enables an individual to make mistakes prior to when the individual's or a teammate's life is at stake. Likewise, training in law enforcement is also helpful to enable the law enforcement officers to be properly prepared for various dangerous situations. Furthermore, training is useful in the development of effective tactics geared to a specific threat.

An important component in the training of these individuals is weapons training. Specifically, the use of weapons, such as firearms, to enhance or maintain shooting accuracy and in conjunction with operations involving other persons is particularly important. Infantry combat training has advanced in recent years with the use of computer and video simulations that teach marksmanship and situational awareness. However, despite this evolution, live on ground exercises are still considered to be the backbone of army training. This live "force-on-force" training (i.e., unit vs. unit) is currently conducted using Instrumented-Tactical Engagement Simulation System (I-TESS), where rifle fire is simulated by lasers. The I-TESS system consists of an Infrared (IR) laser mounted and bore sighted on the rifle and IR sensors attached to the helmet and torso of the soldier. The laser beam from the rifle must have a dispersion angle such that the "spot" it projects is large enough that it cannot fall between the sensors and be undetected. However, the I-TESS simulated "bullet" has a much larger diameter (approximately ten inches at 250 yards) than an actual bullet. This can cause some shots to be scored as hits that, in reality, would be near misses while hits below the waist of a target soldier are scored as misses. Additionally, the laser beam does not curve toward the ground like a projectile. Furthermore, because of the speed of the laser beam, there is no need to "lead" a target as would be necessary in the real world.

Another problem with I-TESS, or any other receptor-based system, is that competitive, young soldiers want to win the combat "simulation." This, in turn, may lead to cheating and dishonest tactics. The I-TESS system can be compromised by defeating or degrading the receptors worn by the soldier. Some of these techniques that soldiers have used to degrade the receptors' performance include assuming postures that expose less receptors, blocking receptors with their hands and arms, smearing receptors with mud, or even covering the receptors with tape. An unintended consequence of these techniques in the laser engagements may be that soldiers may lack a realistic respect for enemy fire.

Navy SBIR 2016.2—Topic N162-080 entitled "Optically Based Small Arms Force-On-Force Training System" discusses some of the problems associated with simulated laser shooting systems. This SBIR discusses the negative training which results from improper techniques in cover and concealment in combat. It has been shown that proper cover and concealment techniques by soldiers greatly increases the survival rate and reduces the casualty rate of a soldier in combat. One of the shortcomings of currently used laser simulated system, I-TESS, is the negative training resulting because these systems do not provide realistic cover and concealment scenarios in exercises. The laser is blocked by obstacles that, in reality, would only provide concealment and would not provide cover (protection) from shots being fired at the soldier. Therefore, it would be advantageous to have a system and method which provides realistic training in marksmanship skills, leading moving targets, adjusting the barrel elevation based on target range as well as proper cover and concealment techniques.

In addition, although there are no known prior art teachings of a system such as that disclosed herein, a prior art reference that discuss subject matter that bears some relation to matters discussed herein is U.S. Patent Application Publication 2007/0190494 to Rosenberg (Rosenberg) and U.S. Pat. No. 6,813,593 to Berger (Berger). Rosenberg discloses a targeting gaming system for a group of users, where each user has a portable gaming device. Rosenberg is utilized for gaming and does not have any real-world military application. Furthermore, Rosenberg does not disclose using real firearms or providing realistic training in marksmanship skills. Berger is a simulator which simulates the firing of a weapon at one or more targets. The simulator includes a sensor for acquiring several images of at least one of the targets. The simulator of Berger also includes an image processor for detecting and analyzing change among the images. Furthermore, each potential target is equipped with a flashing infra-red lamp. The simulator determines changes in images (i.e., movement) and a specific frequency of the lamp to determine which target has been fired at (see col. 4, lines 35-50 of Berger). Berger requires an active target which emits an electronic emission (e.g., infra-red light) as well as movement (i.e., change in the images) to determine a target. Berger fails to teach or suggest a system which uses passive targets (i.e., no requirement to emit an infra-red light or movement in the captured images) to determine if the target is legitimate. Furthermore, Berger does not teach or suggest that the system include an optical system which is aligned to the sight of the firearm (i.e., where the bullets would hit if the firearm was actually fired) and captures an image when a trigger is pulled. Berger merely discloses using a seeker head to acquire a target. It should be noted that Berger discusses the use of the weapon being a guided anti-tank missile system. In a guided anti-tank missile system as disclosed in Berger, a seeker head can be offset from the target and still hit the target (e.g., use of gimbals for use in seeing and locking onto a target). This is completely different than a hand-held firearm which uses a static sight to determine where a bullet would hit. Likewise, Berger fails to disclose using a real firearm for the simulated shooting. Moreover, Berger is a single missile simulator and is not utilized in force-on-force exercises for use with a plurality of combat soldiers.

Current systems provide some training, but in some ways, because of the shortcomings explained above, this training can be counter-productive by which the soldier or shooter is training in operating a weapon which is not accurate in portraying where a bullet hits. Currently, the United States military has no way to evaluate force-on-force marksmanship. Target practice on a range fails to provide sufficient training for soldiers using rifles in a tactical scenario, such as when running for several hundred meters, seeking cover and concealment, and accurately firing the firearm. It would be advantageous to have a system and method which utilizes an optical system which captures an image and determines a hit or miss based on the orientation of the weapon and ballistics of the munition utilized as well as location services for identifying the target. Furthermore, it would be advantageous to have a system and method which utilizes real weapons which will be actually used in combat in force-on-force exercises to provide accurate marksmanship training to soldiers. It is an object of the present invention to provide such a system and method.

SUMMARY OF THE INVENTION

In one aspect, the present invention is directed to a shooting simulation system. The system includes a plurality of firearms. Each firearm is associated with a separate soldier having a man-worn computer, a location device for determining a location of the soldier and an optical system for capturing an image where the captured image provides information on a trajectory of a virtual bullet fired from a shooting firearm. The optical system is aligned relative to a known sight of the shooting firearm and captures the image when shooting the firearm. Additionally, the system includes an orientation device for obtaining the orientation of the firearm when shooting the firearm. The system also includes a shooter/target location resolution module for identifying a valid target from a geographic location of a targeted soldier and the orientation of the firearm, a target image recognition module for determining an impact location of a virtual bullet from the shooting firearm and determining if an identified target from the captured image is a hit or a miss.

In another aspect, the present invention is directed to a method of simulating firearm use. The method begins shooting a firearm aiming at a target. A location of the target is used to determine the identity of the target and if a target targeted by the shooting firearm is a valid target. The orientation of the shooting firearm is also obtained when the firearm is shot. The optical system captures the image when shooting the firearm. Information on a trajectory of a virtual bullet fired from a shooting firearm by the captured image is determined and used to determining an impact location where the virtual bullet from the shooting firearm would impact from the captured image and the trajectory of the virtual bullet. From the determined impact location of the virtual bullet and if a target is a valid target, a hit or a miss of the virtual bullet on the target is calculated.

DESCRIPTION OF THE INVENTION

Figure 1:
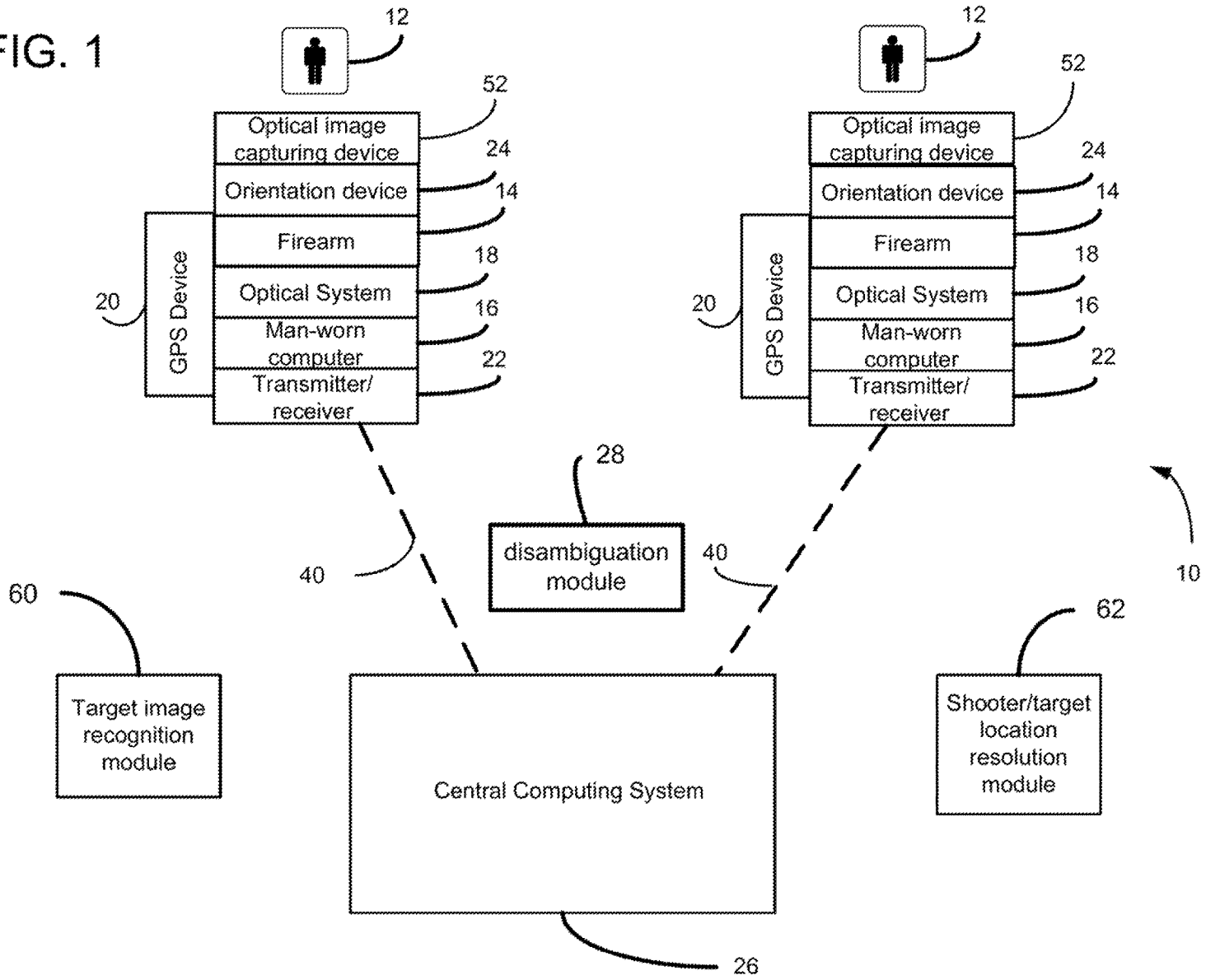
FIG. 1 is a block diagram of components of a shooting simulation system in a first embodiment of the present invention.

The present invention is a shooting simulation system and method. FIG. 1 is a block diagram of components of a shooting simulation system 10 in a first embodiment of the present invention. The system includes a plurality of soldiers 12, each soldier having a weapon, such as a firearm 14, a man-worn computer 16, an optical system 18, a Global Positioning System (GPS) device 20, a wireless transmitter/receiver 22 and an orientation device 24. The man-worn computer 16, the optical system 18, the GPS device 20 and the transmitter/receiver may be carried by the soldier 12 or attached to the firearm 14. The orientation device 24 is affixed to the firearm and provides data on the orientation of the firearm (i.e., pitch, yaw, and roll). The term "soldier" is used to refer to a person carrying the firearm 14, riding in a vehicle (ground or airborne), or locating in an enclosure or any artificial structure but is not limited to persons associated with the military but may be encompassed for use by any organization where its members utilizes weapons. The system also includes a central computing system 26 in communication through the transmitter/receiver 22 to each soldier's man-worn computer 16. The GPS device 20 may generate a geographic location indicia providing an exact location of a specific firearm and associated soldier. This geographic location indicia may be provided to the central computer system 26 or a shooter/target location resolution module 62 (FIG. 1), and, in turn, distributed to each of the man-worn computers 16 of other soldiers. In addition, the system may include a target image recognition module 60 which determines a hit or miss of a shot fired from a firearm. The target image recognition module 60 may be located anywhere in the node, such as with the central computing system 26, one of the man-worn computers 16 or any other node communicating in the system 10. In one embodiment of the present invention, the system 10 may be utilized in a simulated combat training session having a plurality of soldiers associated with two or more sides or teams. In discussing the present invention, the term "shooting" refers to triggering the firearm for the notional firing of virtual bullets.

Figure 2:
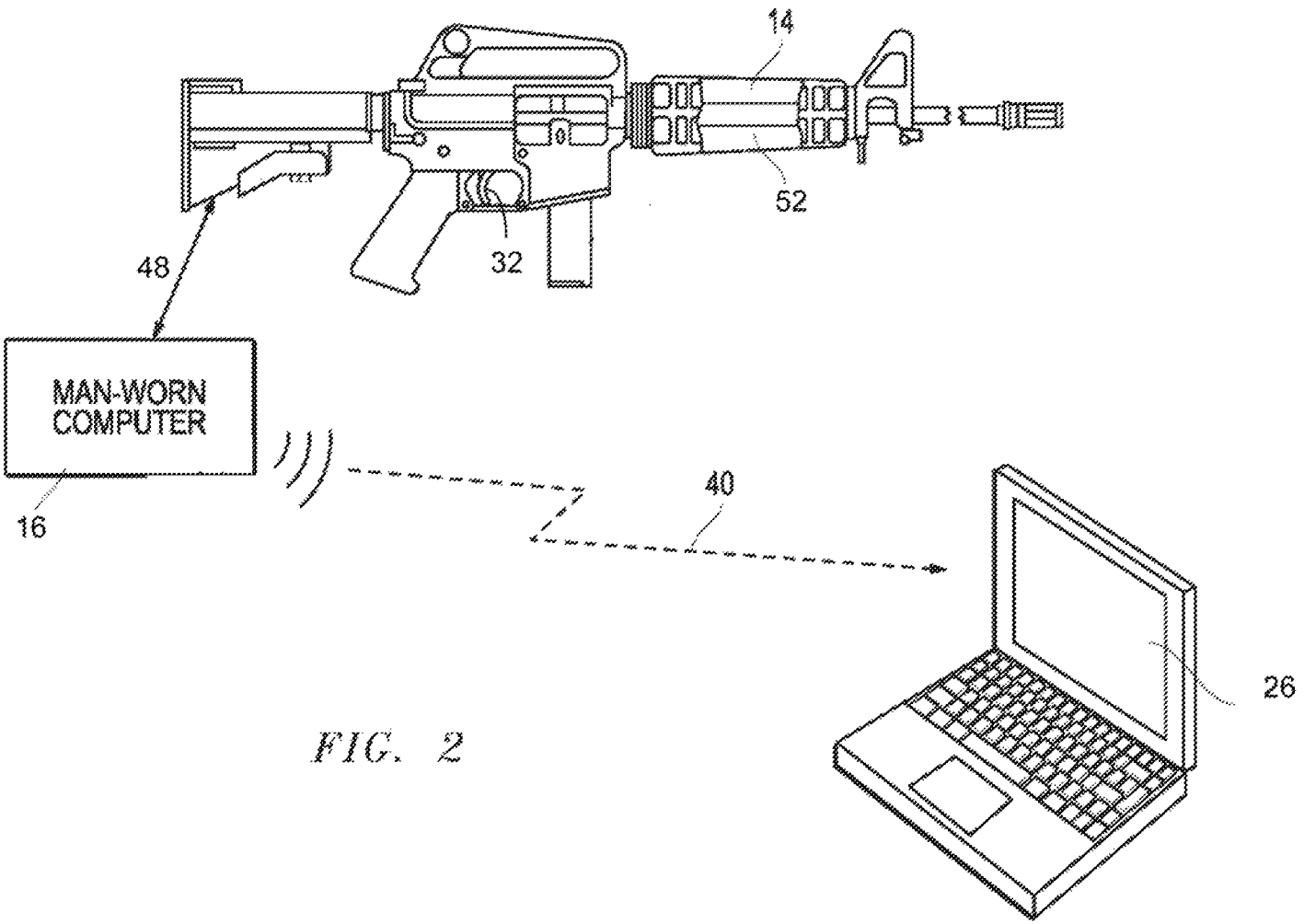
FIG. 2 is a side view of the firearm and central computing system in one embodiment of the present invention.

FIG. 2 is a side view of the firearm 14, man-worn computer 16 and the central computing system 26 in one embodiment of the present invention. The firearm 14 includes an optical image capturing device 52 mounted and aligned to a known sight of the gun. The firearm 14 may include a trigger 32. The firearm may be any line of sight weapon either carried by a soldier 12 or a vehicle (airborne or ground). The man-worn computer may be any device having a processor. In addition, the man-worn computer 16 may have an optional display (not shown) for displaying information to the soldier. Furthermore, the man-worn computer may allow receipt of audio special effects, such as blast noises. The wireless transmitter/receiver and optical system may also be located within the man-worn computer 16 or integrated within the firearm 14. The man-worn computer includes components which may or may not be separate from the firearm. In another embodiment, all or some of the components of the man-worn computer are integrated into the firearm. The firearm may be any type of weapon, such as a pistol, rifle, shotgun, rocket propelled grenade launcher (RPG), bazooka, or any other line-of-sight weapon carried by an individual or mounted upon a vehicle or aircraft. The firearm may be an operable weapon or a replica weapon. Additionally, the firearm may be attached to a vehicle, such as a tank, jeep, aircraft, watercraft, etc. The wireless transmitter/receiver 22 may be any device which transmits and/or receives data via a communications link 40 to the central computing system 26, such as a standard 801.11b wireless connection, a telephonic or cellular connection, a Bluetooth connection, etc. In addition, the optical system 18 or man-worn computer may include a rangefinder, such as lidar, for ranging the distance from the firearm to the target. Additionally, the target may be another soldier or a vehicle, such as a tank, watercraft, aircraft, or vehicle for which the soldier is located. Thus, the present invention may be used for military exercises using virtual munitions. In this discussion, bullets may include any line of sight munitions, projectile or bullet.

The optical system 18 may include the optical image capturing device (mounted on the firearm) which captures an image when the trigger is actuated. The optical image capturing device 52 is aligned relative to a known orientation or sight of the firearm and captures an image when the trigger 32 is actuated. The image is then recorded and stored in one or more modules, such as the target image recognition module 60, the man-worn computer 16 or the central computing system 26. Furthermore, the image recording device may be integrated into a scope used on the firearm. The optical system 18 may be located in the firearm or portions of the optical system and with the exception of the optical image capturing device, may be separate from the firearm but still carried by the soldier (e.g., in the man-worn computer 18). In addition, the optical image capturing device may transmit the captured image without recording the image, as the image may be recorded in another node, such as the man-worn computer. In one embodiment, the firearm and associated components (i.e., the optical image capturing device) may communicate via a wireless or wired link with the man-worn computer. In one embodiment, the optical system, with the exception of the optical image capturing device, and/or man-worn computer are incorporated in a smart mobile phone.

Figure 3:
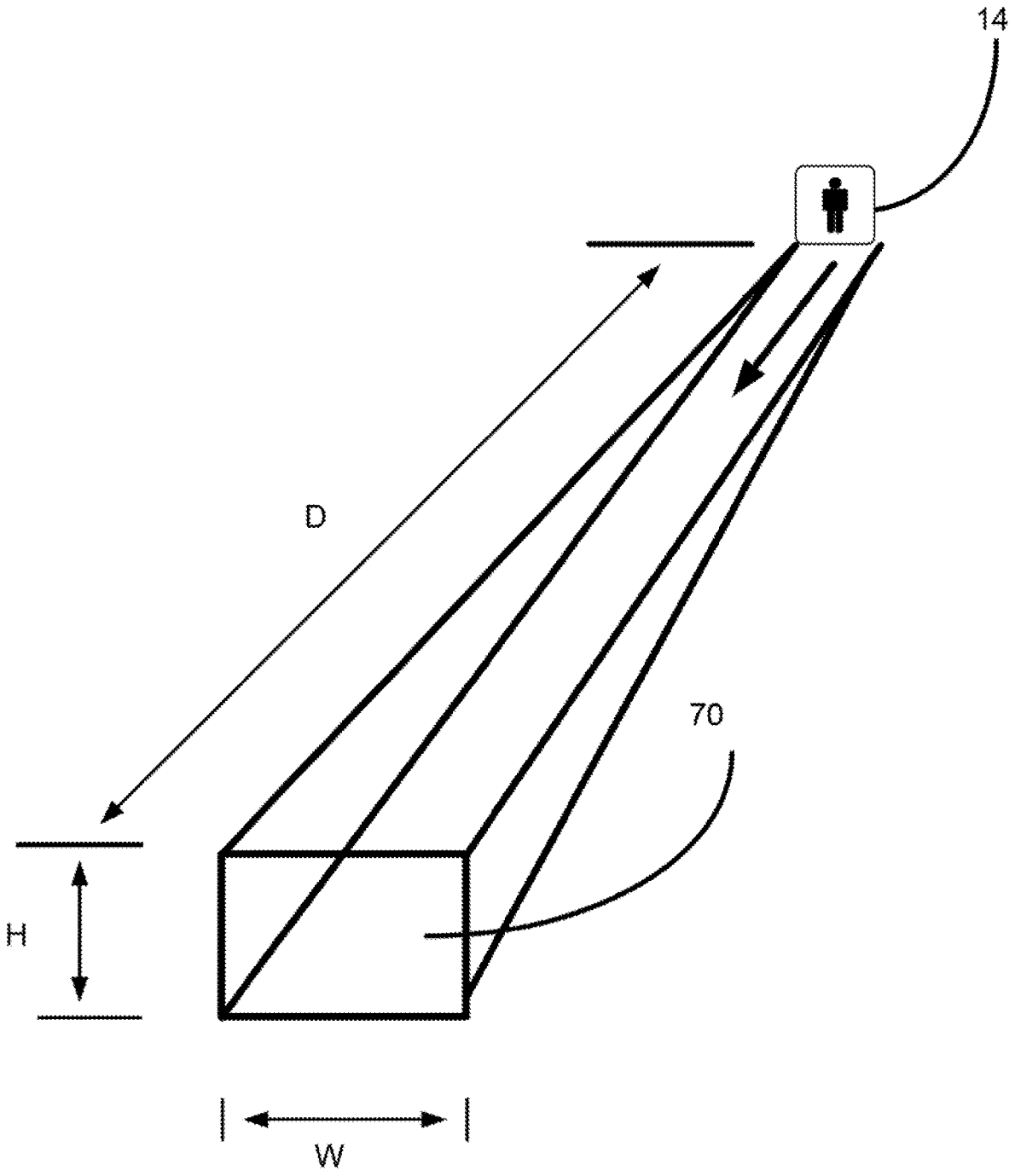
FIG. 3 illustrates a simplified diagram of a resolution zone.

The system 10 may include the target image recognition module 60 which may be located anywhere in the system, such as the man-worn computer 16, the central computing system 26 or in another node of the system 10. The target image recognition module 60 may store data on ballistics for bullets or other munitions which would be fired from the firearm. The target image recognition module 60 is utilized to determine where a firearm's virtual bullets/munitions impacts, i.e., the impact location, relative to the intended target based on the captured image at the time of trigger actuation. Furthermore, target image recognition module 60, utilizing the calculated impact location, provides the functionality on determining if a hit or miss is awarded for the captured image based on where the virtual bullets/munitions of the firearm are calculated to hit relative to the target by the target image recognition module 60. Additionally, the system may include a shooter/target location resolution module 62 which may utilize coordinate system mathematics to determine if a valid target is within a predetermined resolution zone 70, as depicted in FIG. 3, based on data obtained from the orientation device 24 and the geographic location indicia of the soldiers. The orientation device 24 may obtain the three-dimensional orientation of the firearm relative to a geometric or any other fixed frame of reference. The orientation may take the form of pitch, yaw and roll rotations about fixed axes (e.g., X, Y, Z). In one example of a three-dimensional reference scheme, Euler angles may be utilized which are three angles which define the orientation of a rigid body with respect to a fixed coordinate system. The orientation of the shooting firearm may be obtained through the measurement of the three elemental rotations (e.g., yaw, pitch, roll).

FIG. 3 illustrates a simplified diagram of a resolution zone 70. The resolution zone 70 projects for a predetermined distance D consistent with a calculated range from the firearm 14. The zone encompasses anywhere between an error width W and height H. This zone is a possible zone to which a bullet can impact. The shooter/target location resolution module 62 may also be located anywhere in the system, such as the man-worn computer 16, the central computing system 25 or any node within the system 10. The zone is a field of direction and azimuth extending from the shooting firearm outward. The shooter/target location resolution module 62 determines if, as calculated using the orientation of the firearm and the location of the shooter and target, if a valid target lies within the resolution zone. This valid target resolution is preferably performed prior to the target image recognition module 60 calculating the impact location of the bullet as the computation is faster and consumes less computing power by resolving if a target is within the resolution zone 70. Once the shooter/target location resolution module 62 determines that a target is identified as being in the zone 70, the second more computing intensive procedure may be performed by the target image recognition module 60. Additionally, the shooter/target location resolution module 62 may utilize the motion of the target to determine if the target is a legitimate target and determine if the target was properly led to intersect with the bullet.

The target image recognition module 60 may utilize silhouette extraction techniques of targets (e.g., soldiers, vehicles, human forms, etc.) to determine and recognize a target. For instance, silhouette extraction of targets may be obtained by utilizing computer vision techniques as well as ancillary identifiers, such as helmets, gun shape, vehicle features, etc. Furthermore, as targets are known to the system, the potential targets can be photographed and added to a database and artificial intelligence may learn to recognize specific targets.

The man-worn computer 16 may also include an aural system, which may be incorporated in the firearm itself or as a separate component worn by the soldier 12. The aural system may provide an indication of when a hit has been calculated against the targeted soldier (e.g., designating a kill to the targeted soldier), near miss cues (e.g., bullet flyby noise for close shots).

The target image recognition module 60 may determine if the image is a recognizable target (e.g., a human form). The target image recognition module 60 may utilize several sources of information to verify the validity of the target. Furthermore, the target image recognition module 60 may include ballistic data of a projected firing of a bullet or other type of projectile utilized by the firearm to determine where the bullet would hit. Moreover, the shooter/target location resolution module 62 may receive the geographic location indicia of soldiers utilizing the system 10 and identify a target within the zone 70. In one embodiment, the shooter/target location resolution module 62, by obtaining the geographic location indicia of both the shooter and the target, may know the range between the firearm and the target. In addition, the target image recognition module 60 may optionally be used to determine an accurate projected trajectory of the bullet (i.e., the bullet ballistics) for the particular target at a determined range, thereby determining an impact location of the bullet. As discussed above, the determination of where a virtual bullet/munition would impact, and thus determine a hit or miss may utilize various forms of data. Furthermore, the orientation device 24 may provide the orientation of the firearm relative to a known three-dimensional coordinate system through the measurement of roll, yaw and pitch rotations of the firearm, the distance to the target, weather conditions (wind, altitude, etc.), movement of the gun, etc. which may also be used to determine the trajectory of the bullet/munition and its impact location. The calculated bullet's trajectory from the target image recognition module 60 is then used to determine where the bullet would have hit, and from the determination of the bullet's virtual position relative to the intended target, a determination of a hit or miss may be accomplished. Thus, the present invention may be utilized to accurately determine the position where the virtual bullet would impact, i.e., the impact location, relative to the target, and thereby determine if it is a hit or miss. A hit may be defined by predetermined constraints, which may be stored in the man-worn computer, central computing system or other node in the system for determining a hit. The man-worn computer 16 may utilize various navigation and motion systems to collect data for accurate determination of the bullet's trajectory and/or location of the soldier, such as GPS, accelerometers, and magnetometers. The ultimate determination of a hit or miss is accomplished by the target image recognition module 60 if a valid target is determined to be within the resolution zone as determined by the shooter/target location resolution module 62.

In one embodiment, the captured image, a portion of the image (relevant cropped image) or several images and any relevant data are sent to the target image recognition module 60. In one embodiment, the target image recognition module 60 resides in the man-worn computer 16. In another embodiment, the target image recognition module 60 resides with the central computing system. The optical system of the firearm, in one embodiment, to reduce transmission data, may send a cropped image of the relevant portion of where the virtual bullets or munitions would impact (impact location) to any remotely located target image recognition module 60. The central computer may also provide the functionality to manage a wireless network encompassing the plurality of soldiers having firearms 14. The target image recognition module 60, through information gathered from the shooter/target location resolution module 62 (whether a valid target is within the resolution zone 70) and the target image recognition module 60 (impact location of the bullet) determines a hit or miss. As discussed above, the target image recognition module 60 may reside anywhere within the system. In one embodiment, the target image recognition module 60 resides with the central computing system 26. The central computing system may provide overall control of a training session, such as tabulating and informing soldiers of a hit, a kill or a miss, and control timing of the training session. Furthermore, where a target is concealed behind objects such as bushes, trees or buildings, the target image recognition module 60 or other node or module may determine the probability of a hit, kill or miss. The shooter/target location resolution module 62 along with the target image recognition module 60 may resolve the majority of shooting scenarios realistically, however there are situations where more analysis is needed for a realistic simulation. A disambiguation module 28 may be utilized in various scenarios. The disambiguation module 28 may reside anywhere in the system, such as the man-worn computer or the central computing system. In one scenario, a common tactical technique used by soldiers is known as "recon by fire." From a covered position, soldiers fire into a location where enemy soldiers may be concealed behind bullet penetrable objects, such as bushes. In the real world, the shooting soldier would see or hear an active response, return fire, sounds, movement or get no response. The shooter/target location resolution module 62 is aware of the enemy's location and if outside the resolution zone, issues a miss. However, if the shooter/target location resolution module 62 determines that the enemy is within the resolution zone, the target image recognition module sees bushes and cannot determine hit/miss. The real-world soldier also cannot know a hit/miss with certainty. In this case, the system would apply a hit probability based on the number of bullets fired into the resolution zone. Another possibility is that the enemy soldier is not only concealed by bushes but also covered by an impenetrable wall. To resolve this situation, the system may utilize a terrain database (most live training occurs at bases where the terrain is well known). In this scenario, the shooting soldier would get a miss just as he would in the real world. In another situation, where a soldier leads a moving target, further calculations must be made. To determine a hit/miss, the system, through the disambiguation module, must compute the path of the target and the bullet to determine if they intersect at a point in time. Subsequent images taken before and immediately after the trigger pull may be used to verify computations, using velocity of the target and bullet ballistics. In one embodiment of the present invention, a terrain database and/or artificial intelligence (AI) may be utilized. This image-based system is ideal for establishing and maintaining a high-fidelity representation of real-world terrain features. During a training exercise, each shot fired will yield at least one high resolution uncompressed image. The man-worn computer has the capacity to save complete images including misses and a large portion of the image which is not needed by the target image recognition module to determine hit/miss. Each image may be logged with geographic location and field of view orientation. Hundreds of images from exercises may be added in to update the database with changes to structures and seasonal foliage. Saved images that contain a valid target including misses may also be used to train AI programs.

It should be understood, that the calculation of a hit or miss as well as the identity of the target is determined by information gathered by the target image recognition module 60 and the shooter/target location resolution module 62 and does not require the use of beacons or other identifying indicia worn by the targeted soldier or vehicle. Thus, the present invention utilizes sensors/data obtained from the captured image and the location indicia generated by the GPS device of each firearm and the targeted soldier is a passive target which emits no active electronic emissions for identifying the targeted soldier.

In another embodiment, the determination of a hit or miss from virtual bullets/munitions can be calculated in a distributed network, where specific calculations or procedures are done by specific components (nodes) in the network. For example, some of the calculations may be conducted by the man-worn computer while other calculations are completed by the central computing system. In one embodiment as discussed below for system 110, the target image recognition module 60 (which may reside in the central computing system 26) adjudicates (determines) if a virtual bullet/munition fired by the shooting firearm is a hit (including where the hit is on the target), kill, miss on a target and what target. To illustrate, the optical image capturing device captures the image. In a first calculation step, the shooter/target location resolution module 62 determines if a valid target lies within the resolution zone. The shooter/target location resolution module 62 determines if a valid target from information such as orientation of the firearm and the geographical locations of the shooter and the target is within the resolution zone. In this first calculation step, if it is determined that the target does not lie within the resolution zone 70, no further calculation is necessary as the shot would be considered a miss. However, if it is determined that a valid target lies in the resolution zone 70, a second calculation step may be performed by the target image recognition module 60 which utilizes stored ballistics for the firearm and munitions used as well as using the captured image to determine a more exact and accurate impact location of the bullet or munition. This information is then utilized by the target image recognition module 60, which determines a hit or miss. In another embodiment, for a moving target, the target image recognition module 60 or disambiguation module 28 calculates where the moving target would be by using the distance traveled by the target over a certain time and from this information, determine if a bullet/munition would hit the target. In this way, a soldier may practice 'leading' the moving target, to provide realistic marksmanship training. Furthermore, the system may employ artificial intelligence (AI) to learn from each training session to improve the accuracy of the hit/miss adjudication. Also, in another embodiment of the present invention, each soldier may include ancillary identifiers which assists the optical system in determining if the target is a human.

With reference to FIGS. 1-3, the operation of the system 10 will now be explained. A plurality of soldiers 12 enters an area of training operations. Each soldier 12 carries a firearm 14 and a man-worn computer 16. In one embodiment of the present invention, the GPS device 20 worn by each soldier generates a location indicia. The location indicia provides the exact location of the soldier. This information may optionally be sent to the shooter/target location resolution module 62 or other soldiers' man-worn computers for use in determining an identification and/or targeting solution. A soldier observes an opposing soldier or target, aligns the firearm in exactly the same fashion as if the soldier was aiming the firearm to actually fire live fire munitions (i.e., the soldier uses a scope or sight to target the opposing soldier or target. The soldier, upon determining that the firearm is correctly aimed, actuates the trigger 32. Next, the optical system 18 captures the image, partial image, or images and optionally any relevant data related to the estimated trajectory of the bullet (e.g., wind, altitude, motion, orientation of the firearm, etc.) during the act of shooting. Next, in a first calculation step, the shooter/target location resolution module 62 may determine if a valid target lies within the resolution zone 70. The shooter/target location resolution module 62 determines if a valid target is in the resolution zone from information such as orientation of the firearm, the geographical locations of the shooter and target, and the range between the shooting firearm and the target. In this first calculation step, if it is determined that a valid target is not within the resolution zone 70, no further calculation is necessary as the shot would be considered a miss by the shooter/target location resolution module 62. However, if it is determined that a valid target lies in the resolution zone 70, a second step calculation performing a more refined target resolution may be executed by the target image recognition module 60 which utilizes stored ballistics for the firearm and munitions used as well as using the captured image to determine a more exact and accurate impact location of the bullet or munition. Additionally, the target image recognition module may utilize range information obtained from the shooter/target location resolution module to calculate bullet drop of the fired virtual bullet as well as assist in identifying targets based on image size. This information is then used by the target image recognition module 60 to determine a hit or miss.

The target image recognition module 60 may store ballistic data for the firearm as well as the shooting conditions to assist in determining where the virtual or notional bullets/munitions would actually hit based on parameters at the time of firing. As discussed above, the determination of whether a valid target lies in the resolution zone 70 performed by the shooter/target location recognition module 62 may utilize various forms of data. The inclination and orientation of the barrel of the gun, distance to the target, location of the target and shooter, etc. may be used to determine if any valid target is being targeted within the resolution zone 70. If there is no valid target within the resolution, no further calculations are necessary since there is no possibility of hitting a target if there is no target. However, if there is a valid target identified within the resolution zone 70, the target image recognition module 60 may, using various types of data, perform a determination or second calculation by the system to determine the impact location of the bullet/munition. Various types of information may include the movement of the gun, weather conditions (wind, altitude, etc.), range between the shooting firearm and the target, ballistics of the firearm and munition may all be used to determine the trajectory of the bullet in combination of extracting a trajectory from the captured image. The target image recognition module 60 may utilize various navigation and motion systems to collect data for accurate determination of the bullet's trajectory and/or location of the soldier, such as GPS, magnetometers, and accelerometer. Thus, the shooter/target location resolution module 62 first identifies if a valid target is within the resolution zone and the target image recognition module 60 determines the impact location of the bullet. Furthermore, the target image recognition module 60 determines if the impact location of the bullet is a hit or miss.

The central computing system may receive the hit or miss data from the target image recognition module 60 and may independently determine/verify a hit or miss of the target. In addition, the central computing system then manages the location of all the soldiers as well as compiling all the hits and misses of each soldier at a specific location and time during the simulation. This compilation may be used for debriefing of the soldiers and determination of the success of each soldier and each team. The central computing system may compile such data as time of firing, accuracy, number of bullets fired, times the soldier is targeted, etc. In one embodiment, the central computing system may provide a playback of each encounter providing a graphical representation of each soldier, trajectory of the bullets, etc. In addition, the optical system may capture images which are enhanced by infrared detection or night vision systems enabling optical image pickup in reduced visibility. These images may be downloaded to other computer devices or printed. Furthermore, the central computing system may send back information on a hit or miss to the intended target. For example, the target (targeted soldier or other object) may be informed that he is killed by receiving an aural warming. The target image recognition module 60 may also determine where a hit occurs on the target and if the target is killed or disabled. In addition, where a target is hidden behind cover (e.g., a building) or concealment (e.g., a bush), the man-worn computer or central computing system may determine if the target is hit. A Monte Carlo simulation which provides probability of random events (e.g., whether a bullet would hit a concealed target) may be employed for determining a hit. This may include a probability chart based on variables such as range, shots fired, etc.

The present invention may also utilize an aural system to alert a soldier that the soldier has been hit or utilize blanks fired from the firearm to provide realistic sounds during the simulation (e.g., firing of the firearm, such as the firing of blanks or bullets passing in close proximity to the soldier).

Figure 4A:
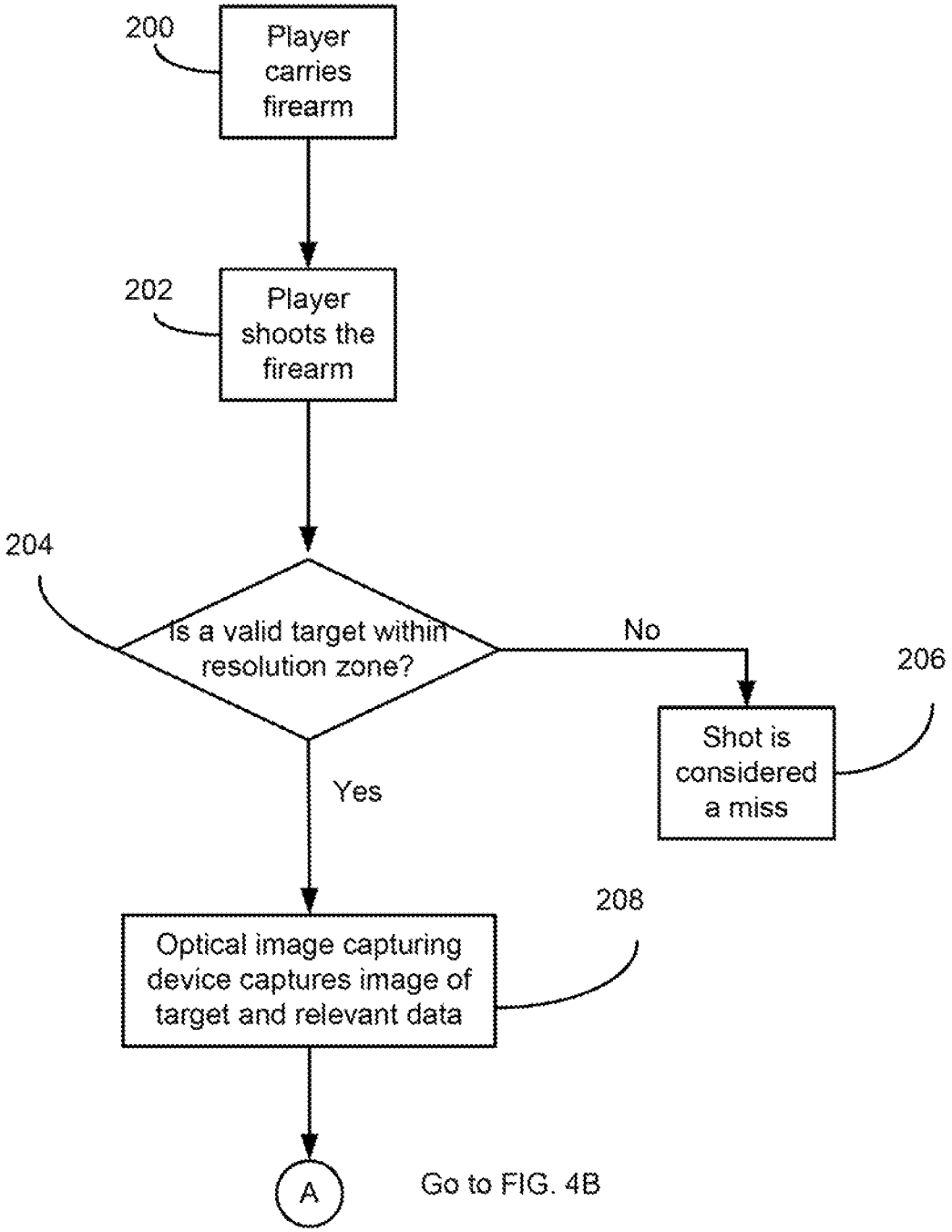
FIGS. 4A and 4B are flow charts illustrating the steps of simulating firearm utilizing the system of FIG. 1 according to the teachings of the present invention.
Figure 4B:
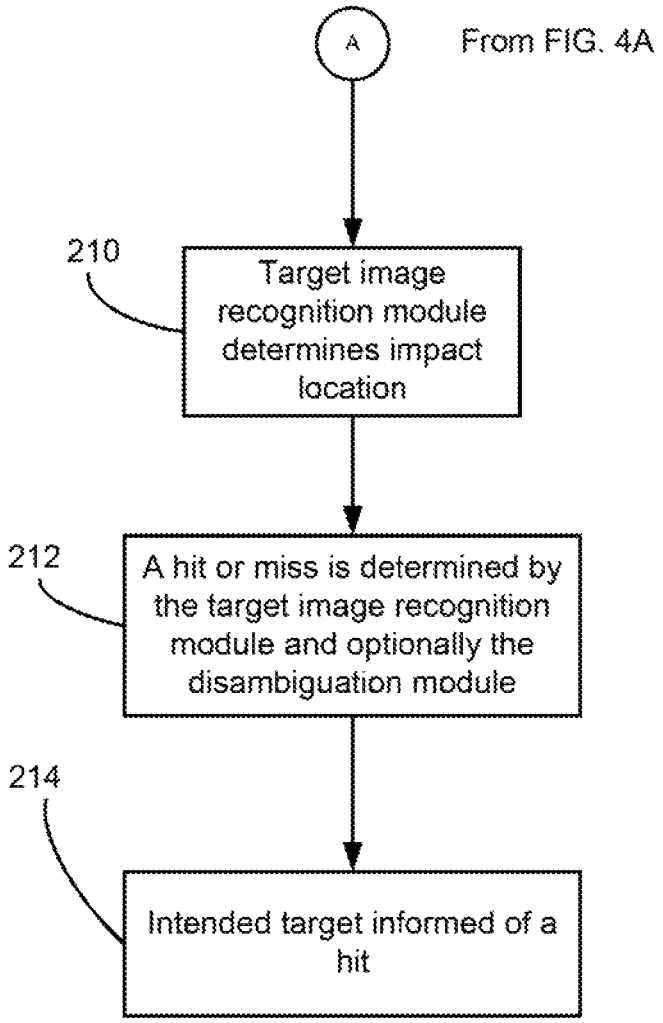

FIGS. 4A and 4B are flow charts illustrating the steps of simulating firearm utilizing the system 10 according to the teachings of the present invention. With reference to FIGS. 1-4, the method will now be explained. In step 200, each soldier 12 carries a firearm 14 and the man-worn computer 16. In one embodiment of the present invention, the GPS device of each soldier generates a location indicia which may be transmitted to the central computing system 26 or other soldiers' man-worn computers 16. Next, in step 202, a soldier observes another soldier (or target) and when desired, shoots the firearm by aligning the firearm in exactly the same fashion as if the soldier was aiming the firearm to actually fire and actuates the trigger 32. Next, in step 204, it is determined if a valid target lies in the resolution zone 70 based on the location of the shooter, location of the target, the range between the shooting firearm and the target, and the orientation of the firearm (i.e., pitch, roll, yaw of firearm). If it is determined that there is no valid target within the resolution zone 70, the method moves to step 206 where the process ends, since there is no target, there is no possibility of a hit (i.e., a miss). If, in step 204, it is determined that a valid target lies within the resolution zone 70, the method moves to step 208 where the optical image capturing device 52 captures the image or images during the act of shooting the firearm (i.e., prior to trigger actuation, during trigger actuation, and/or immediately after trigger actuation). Next, the method moves to step 210 where a more refined target resolution may be performed by the target image recognition module 60 which utilizes stored ballistics for the firearm and munitions used as well as using the captured image to determine a relatively exact and accurate impact location of the bullet or munition. Additionally, the target image recognition module may utilize range information obtained from the shooter/target location resolution module to calculate bullet drop of the fired virtual bullet as well as assisting in identifying targets based on image size. In step 210, the target image recognition module 60 may receive a complete image or a partial image of the relevant portion of the image for determining a hit or miss. Next, in step 212, this information is used by the target image recognition module to determine a hit or miss. If the image does not show a target but shows a bullet penetrable object or the target is moving too fast (determined by target velocity, munition, and range), the target image recognition module may optionally utilize the disambiguation module 28 for further analysis. If the image shows a known impenetrable terrain, the shot is considered a miss.

The target image recognition module 60 may optionally send the hit/miss information and any relevant data to the central computing system which then manages the location of all the soldiers as well as compiling all the hits and misses of each soldier at a specific location and time during the simulation. This compilation may be used for debrief of the soldiers and determination of the success of each soldier and each team. The central computing system may compile such data as time of firing, accuracy, number of bullets fired, times the soldier is targeted, etc. In one embodiment, the central computing system may provide a playback of each encounter providing a graphical representation of each soldier, trajectory of the bullets, etc. In addition, the central computing system may independently determine/verify a hit or miss of the target. Since the central computing system includes the position of each soldier and the information on the triggered firearm (e.g., heading and inclination of barrel, distance to target, etc.), the central computing system may determine/verify a hit or miss. In step 214, this verification of a hit may be sent back to the intended target (i.e., the targeted soldier) to inform of a hit.

The present invention may optionally utilize geographic location indicia generated by the GPS device 20 carried with each soldier. The GPS device may then transmit this location indicia to the shooter/target location recognition module 62 where the location of each soldier, both target and shooter are determined. This location indicia may be used to identify the appropriate target and shooter and user to determine if the projected impact location of the bullet or munition is within the resolution zone 70. To minimize data transmission, location data could be sent only to soldiers within range of one another In another embodiment of the present invention, the system 10 may perform the various computing functions in a distributed network. In this network, the firearm (man-worn computer) communicates with one or more firearms (man-worn computer) using the wireless transmitter/receivers 16. Any necessary information is passed from one node (i.e., firearm or man-worn computer) to another node. In one embodiment, the wireless transmitter/receiver enables the use of a wireless network for communicating between each firearm/man-worn computer. The functionality of the target image recognition module 60 and the shooter/target location resolution module 62 may reside in any node, such as a man-won computer or the central computing system 26 depending on where efficiency and reduced latency occurs.

The various components (e.g., parts of the optical system, wireless transmitter/receiver, image recording device, etc.) associated with each firearm in system 10. For example, the man-worn computer may be a separate component worn by the soldier and communicating with the firearm or may be integrated into the firearm. Furthermore, the firearm may be incorporated with a vehicle, either manned or unmanned.

Although the present invention has illustrated the use of firearms, the present invention may also be incorporated in vehicles, such as tanks, aircraft, watercraft, and armored personnel carriers. The computing system may determine the legitimacy of such targets in its image recognition program. In addition, the present invention may be used for various scenarios such as within law enforcement field or recreational field.

The present invention provides many advantages over existing shooting simulation systems. The present invention does not require the wearing of sensors by soldiers to detect a hit by a laser or other device. Furthermore, the targeted soldier does not need to emit an active electronic emission and may be a passive target. Additionally, in one embodiment, the shooting firearm does not need to emit any spectral emissions to determine if the image is a legitimate target. Thus, the cost of equipment is drastically reduced. Furthermore, the present invention enables the accurate calculation of a bullet's trajectory rather than the straight line of sight calculation used in laser simulation systems. In addition, the present invention provides for the carriage of light weight and cost-effective equipment (i.e., an optical system) for use on the firearm. The present invention may be incorporated in existing operational firearms or built into realistic replicas. Additionally, the present invention may be utilized for bore sighting or zeroing a weapon.

The present invention may be utilized between two soldiers, a single person against another target, a vehicle (including a tank, watercraft, aircraft, or surface vehicle) and another target, or in force on force exercises. Unlike other simulated shooting systems, the present invention goes beyond the mere scoring of a hit or miss. The present invention may be incorporated in real weapons and used for marksmanship training. Thus, the present invention may be used for training with real world firearms.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A shooting simulation system, the system comprising:

a plurality of firearms, each firearm associated with a separate soldier, wherein each soldier has a man-worn computer, a location device for determining a location of the soldier and an optical system for capturing an image, the captured image providing information on a trajectory of a virtual bullet fired from a shooting firearm;

wherein the optical system is aligned relative to a known sight of the shooting firearm, the image recording device capturing the image when shooting the firearm;

an orientation device for obtaining the orientation relative to a known three-dimensional coordinate system of the firearm when shooting the firearm;

a shooter/target location resolution module for identifying a valid target from location information of a targeted soldier;

a target image recognition module for determining an impact location where a virtual bullet from the shooting firearm would impact within the captured image;

wherein the target image recognition module determines if an identified target from the captured image is a hit or a miss.

2. The system according to claim 1 wherein the shooter/target location resolution module utilizes data on an orientation of the shooting firearm obtained from the orientation device, the location of the target and the location of the shooting firearm for identifying a valid target.

3. The system according to claim 1 wherein the location device is a Global Positioning System (GPS) device which generates a known location of the GPS device.

4. The system according to claim 3 wherein the location of the GPS device is a location indicia which is sent to the shooter/target location resolution module.

5. The system according to claim 4 wherein the shooter/target location resolution module determines a range between the shooting firearm and the target.

6. The system according to claim 1 wherein the target image recognition module stores ballistics of the firearm for determining a projected trajectory of the virtual bullet fired from the firearm.

7. The system according to claim 1 further comprising a central computing system communicating with all the man-worn computers.

8. The system according to claim 7 wherein the target image recognition module resides with the central computing system.

9. The system according to claim 1 wherein at least one firearm is affixed to a vehicle.

10. The system according to claim 1 wherein the determination of the trajectory of the virtual bullet and whether the virtual bullet is a hit or miss is performed in a distributed computing network where the calculations are performed by various nodes in the computing network.

11. The system according to claim 1 further comprising a disambiguation module for resolving if a hit or miss of a moving target.

12. The system according to claim 1 further comprising a disambiguation module for resolving if a hit or miss of a concealed target.

13. The system according to claim 12 wherein the disambiguation module applies a Monte Carlo technique for determining a hit or miss of a concealed target.

14. The system according to claim 1 further comprising a disambiguation module utilizing a stored terrain database to assist in determining a hit or miss of a target where terrain is a factor in resolving a hit or miss.

15. The system according to claim 1 wherein the shooter/target location resolution module identifies a valid target by determining if a target is located in a resolution zone, the resolution zone calculated from an orientation of the firearm, the location of the shooting firearm, the location of the targeted soldier and the range between the shooting firearm and the target.

16. A method of simulating firearm use, the method comprising the steps of:

shooting a firearm, wherein the step of shooting includes aiming at a target and triggering the firearm;

obtaining a geographic location of the target to determine the identity of the target;

obtaining the orientation of the shooting firearm relative to a known three-dimensional coordinate system when the firearm is shot;

determining if a target targeted by the shooting firearm is a valid target;

capturing an image during the step of shooting by an optical system associated with the shooting firearm;

providing information on a trajectory of a virtual bullet fired from a shooting firearm by the captured image;

determining an impact location where the virtual bullet from the shooting firearm would impact from the captured image and the trajectory of the virtual bullet; and determining, from the determined impact location of the virtual bullet and if a target is a valid target, a hit or a miss of the virtual bullet on the target.

17. The method according to claim 16 wherein the step of determining if a target targeted by the shooting firearm is a valid target includes the step of utilizing data on the obtained orientation of the shooting firearm, the location of the target and the location of the shooting firearm for identifying a valid target.

18. The method according to claim 16 wherein the step of determining if a target targeted by the shooting firearm is a valid target includes determining if a target is located in a resolution zone, the resolution zone calculated from an orientation of the firearm, the location of the shooting firearm and the location of the targeted soldier.

19. The method according to claim 16 wherein the step of determining a hit or miss includes utilizing a probability scheme to determine a hit or miss of a concealed soldier.

20. The method according to claim 16 further comprising the step of informing an intended target of a hit of the virtual bullet.

* * * * *